US006321745B1

(12) United States Patent
Christianson et al.

(10) Patent No.: US 6,321,745 B1
(45) Date of Patent: Nov. 27, 2001

(54) FOLDING SNORKEL

(76) Inventors: Tony Christianson; Autumn Christianson, both of 2007 Wawona Station, Yosemite, CA (US) 95389

( * ) Notice: Subject to any disclaimer, the term of this patent is extended or adjusted under 35 U.S.C. 154(b) by 0 days.

(21) Appl. No.: 09/562,047

(22) Filed: May 1, 2000

Related U.S. Application Data

(60) Provisional application No. 60/132,522, filed on May 4, 1999.

(51) Int. Cl.[7] ..... B63C 11/16

(52) U.S. Cl. ..... 128/201.11; 128/201.27

(58) Field of Search ..... 128/201.11, 201.26–201.29, 128/200.29, 206.29, 912; 405/186, 187; 181/127, 21

(56) References Cited

U.S. PATENT DOCUMENTS 5,199,422 * 4/1993 Rasocha ..... 128/201.11
5,906,199 * 5/1999 Budzinski ..... 128/201.11
6,079,410 * 6/2000 Winefordner et al. ..... 128/201.11

* cited by examiner

*Primary Examiner*—John G. Weiss
*Assistant Examiner*—Teena Mitchell

(57) ABSTRACT

The instant invention is a skin diving snorkel having a conduit with an end above the water surface, and an underwater end that terminates in a mouthpiece. The mouthpiece provides a flow path between the conduit and the interior of the diver's mouth. The conduit is divided along its length into two or more segments. The end of one segment slips with close clearance into a mating socket of the adjacent end of the next segment. The close fit of mating surfaces provides a substantially watertight joint. A small diameter elastic cord threaded, under tension, inside the conduit joins the conduit segments. One end of the elastic cord is attached to the conduit near the above water opening. The other end of the elastic cord is attached to the conduit near the mouthpiece opening. The elastic cord stretches when the segments are separated, and functions as a hinge that allows the separated segments to be placed side by side even though they remain connected by the elastic cord. The elastic cord holds the segments firmly together when joined, and maintains the proper sequential and alignment relationship between the segments when the segments are separated.

15 Claims, 4 Drawing Sheets

FOLDING SNORKEL

RELATED PROVISIONAL APPLICATION AND DISCLOSURE DOCUMENT

The instant application is related to Provisional Application No. 60/132,522 filed May 4, 1999. The instant application is also related to Disclosure Document Number 451580 deposited Feb. 19, 1999.

BACKGROUND OF THE INVENTION

1. Field of the Invention

The instant invention is generally related to snorkels used by divers and swimmers. More particularly, this invention is concerned with snorkels that can be folded or collapsed for compactness.

2. Description of the Prior Art

Divers and swimmers use the snorkel as a means to breathe while swimming face down on the water surface. The snorkel functions as a conduit between the diver's mouth and the overhead air.

Typically, the snorkel is attached to the diver's facemask strap by means of a clip or retainer. After attachment to the facemask strap, the snorkel conduit is oriented so that one-end fits into the diver's mouth, while the other end extends a short distance above the water surface.

Scuba divers use a snorkel to conserve air while swimming on the surface. When the scuba diver swims below the water surface, the snorkel is usually allowed to hang loosely from the facemask strap.

The snorkel can be an encumbrance when hanging loosely from the facemask strap; for example, the snorkel will contribute to swimming drag and can snag on seaweed or the like. As a consequence, some scuba divers remove the snorkel from the facemask strap and tuck it under the diver's weight belt or stow it in a pocket or the like on the diver's diving dress.

Stowing a snorkel is somewhat difficult underwater because the snorkel is a relatively long tube that will not fit easily into a pocket. A snorkel tucked under the diver's belt may be, and often is, accidentally lost.

A snorkel that can be quickly folded into a compact shape would be very beneficial. Such a snorkel would easily fit into a diver's pocket. Such a snorkel would also be easier to fit in a bag for transportation to and from the dive site. Furthermore, when a snorkel is offered for sale, compact packaging is very beneficial.

A folding snorkel should be both simple and easy to fold and unfold. When unfolded and being used, the snorkel should not leak at the joints. Above all, a folding snorkel should not be able to inadvertently fold while the diver is breathing through it.

In view of the foregoing factors, conditions and problems which are characteristic of the prior art, the instant invention was conceived. It is the object of the instant invention to provide a folding snorkel that can be folded and unfolded quickly and easily, that will not leak at the joints when unfolded, and that will reliably remain unfolded when the diver is using it.

SUMMARY OF THE INVENTION

The instant invention is a skin diving snorkel having a conduit with an end above the water surface, and an underwater end that terminates in a mouthpiece. The mouthpiece provides a flow path between the conduit and the interior of the diver's mouth. The conduit is divided along its length into two or more segments. The end of one segment slips with close clearance into a mating socket of the adjacent end of the next segment. The close fit of the mating surfaces provides a substantially watertight joint.

A small diameter elastic cord threaded, under tension, inside the conduit joins the conduit segments. One end of the elastic cord is attached to the conduit near the above water opening. The other end of the elastic cord is attached to the conduit near the mouthpiece opening. The elastic cord stretches when the segments are separated, and functions as a hinge that allows the separated segments to be placed side by side even though they remain connected by the elastic cord. The elastic cord holds the segments firmly together when joined, and maintains the proper sequential and alignment relationship between the segments when the segments are separated.

DESCRIPTION OF THE DRAWINGS

A detailed description of the invention is made with reference to the accompanying drawings wherein like numerals designate corresponding parts in the several Figures.

DESCRIPTION OF THE PREFERRED EMBODIMENT

The following detailed description is of the best presently contemplated modes of carrying out the invention. This description is not to be taken in a limited sense, but is made merely for purposes of illustrating the general principles of the invention.

Figure 1:
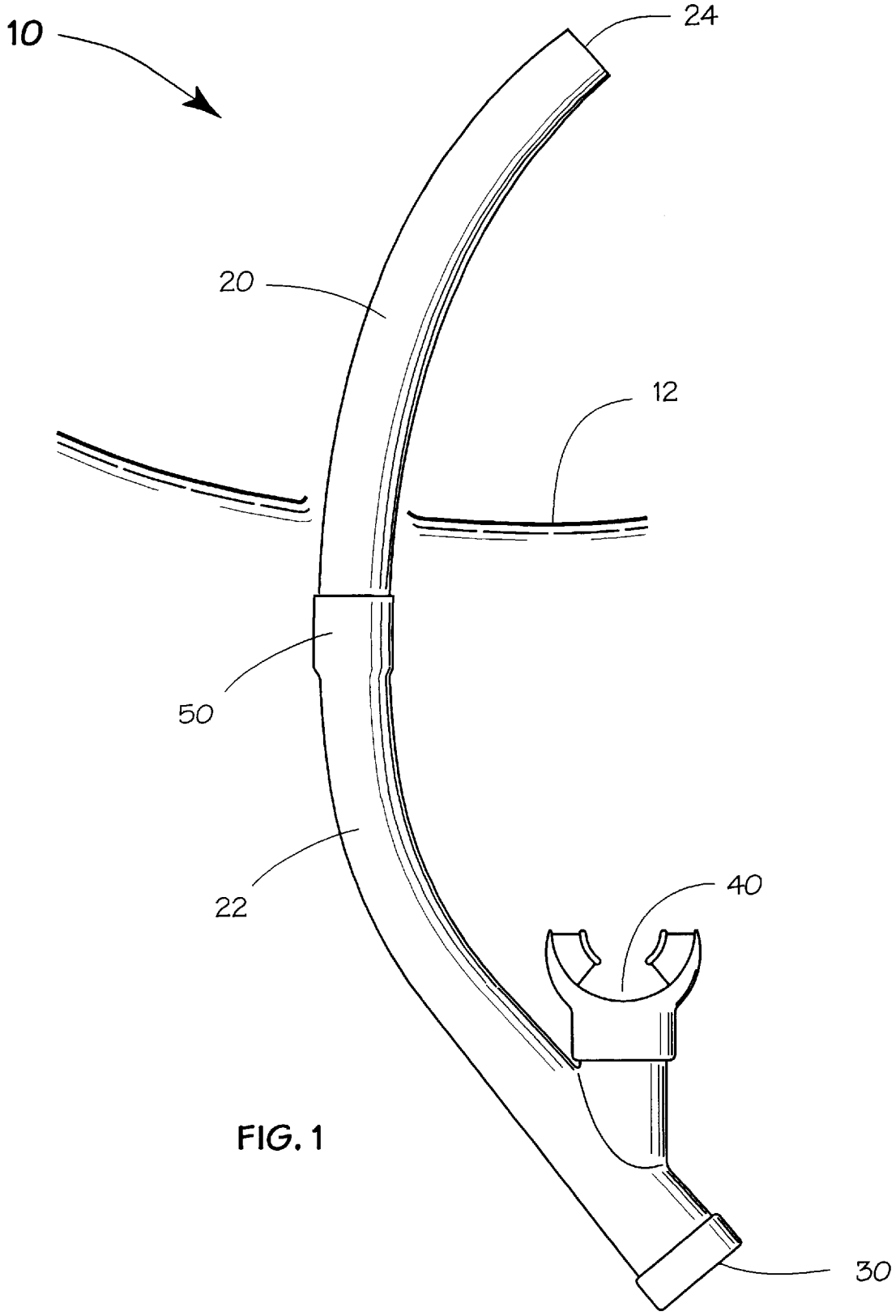
FIG. 1 is a view of a snorkel which has been constructed in accordance with the principles of the instant invention, pictured in the approximate position of use by a diver swimming face down on the water surface.
Figure 2:
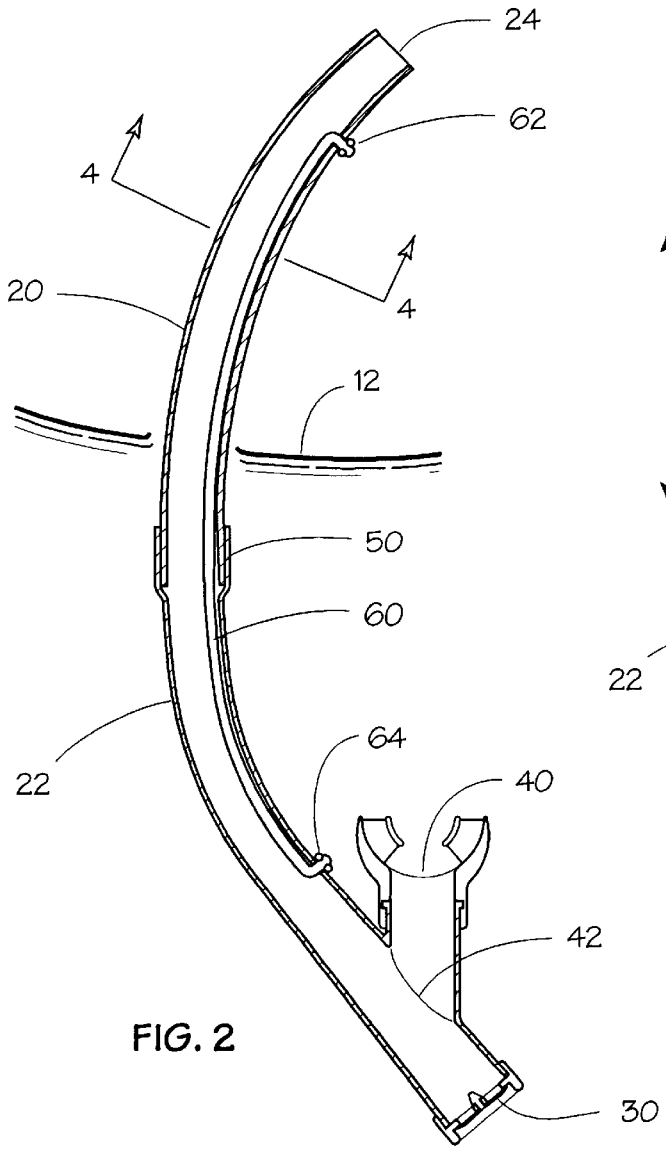
FIG. 2 is a longitudinal sectional view of the snorkel of FIG. 1.

Referring to FIGS. 1 and 2, snorkel 10 is pictured in the approximate position of use by a skin diver swimming face down on water surface 12. (For clarity, the skin diver is not shown in the FIGS.) The words "upper" and "lower" or "above the water surface" and "below the water surface" or-the-like are made with reference to the orientation of snorkel 10 as shown in FIGS. 1 and 2.

Snorkel 10 includes upper conduit 20 that extends into the air above ambient water surface 12. Snorkel 10 also includes lower conduit 22 that is optionally closed underwater by purge valve 30. Purge valve 30 is arranged to allow fluid, for example water or saliva, to flow freely from conduit 22 to ambient. Although the preferred configuration includes purge valve 30, the instant invention can be accomplished without purge valve 30 by terminating the underwater end of conduit 22 at mouthpiece 40.

Purge valve 30 is, typically, a flexible diaphragm of a resilient material, for example silicon elastomer or the like, which is restrained in such a way that it can selectively flex under slight pressure to allow flow in one direction only. Reverse pressure forces the diaphragm to seal closed. Consequently, purge valve 30 will prevent the reverse flow of water from ambient into conduit 22.

Mouthpiece 40, above purge valve 30, branches from the side of conduit 22. Mouthpiece 40 is adapted to be held by the mouth of the diver and provides a flow path from conduit 22 to the interior of the mouth. (In the FIGS., the opening of mouthpiece 40 should be considered covered by the diver's mouth). Shown in FIG. 2, the intersection of mouthpiece 40 with conduit 22 forms an approximately elliptical opening 42.

Conduits 20 and 22 are constructed of a rigid or semi-rigid material, for example vinyl plastic, acrylic, or-the-like. Conduits 20 and 22 are configured to approximately follow the curvature of the diver's head. Consequently, conduit 20 curves smoothly to place upper opening 24 approximately over the center of the head. Alternately, upper conduit 20 can be straight.

Providing a substantially smooth flow path that is free of abrupt changes in path direction facilitates respiration and purging. While not so limited, the curvature of conduits 20 and 22 may, for example, follow an elliptical path around the diver's head.

Figure 3:
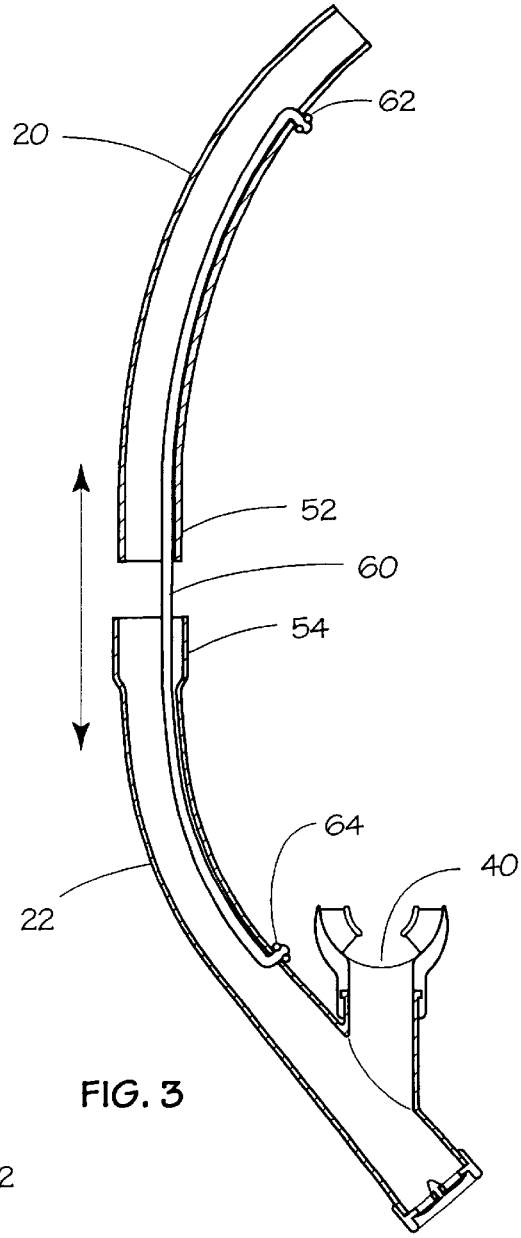
FIG. 3 is a longitudinal sectional view similar to FIG. 2 showing the snorkel segments separated.

Joint 50 joins upper conduit 20 to lower conduit 22. As best shown in FIG. 3, joint 50 is formed by mating extension 52 of conduit 20 with socket 54 of conduit 22. Extension 52 is sized to have a slip fit into socket 54 that is also tight enough to substantially prevent the leakage of ambient water into the joined conduits.

Although socket 54 is shown in the FIGS. to be part of conduit 22, the locations of socket 54 and extension 52 relative to conduits 20 and 22 can be reversed. For example, extension 52 can be a part of conduit 22, and socket 54 can be a part of conduit 20. Alternately, an o-ring seal or-the-like can be incorporated in the joint to further guarantee a watertight seal. As shown by the double arrowed line in FIG. 3, conduits 20 and 22 can easily be separated by pulling them apart.

Elastic cord 60 connects conduit 20 to conduit 22. For the preferred configuration, elastic cord 60 is routed inside conduits 20 and 22. One end of elastic cord 60 is attached to the wall of conduit 20 near opening 24 by being crimped with a retainer at 62. Similarly, the other end of elastic cord 60 is attached to the wall of conduit 22 near mouthpiece 40 by being crimped with a retainer at 64. Although crimping retainers 62 and 64 are pictured as being located external to conduits 20 and 22, the ends of elastic cord 60 can be connected to tabs or retainers, or-the-like, inside conduits 20 and 22 (for an example, see FIG. 7). Furthermore, although the ends of elastic cord 60 are pictured as connected to conduits 20 and 22 at locations near opening 24 and mouthpiece 40, respectively other locations for connection can be used, for example, near mid-length of upper conduit 20 and lower conduit 22, respectively.

Alternately, elastic cord 60 can be routed along the outside of conduits 20 and 22. If elastic cord 60 is routed external to conduits 20 and 22, the close spacing of elastic cord 60 with the conduit wall is best maintained by threading elastic cord 60 through tubes, guides, or-the-like, attached externally to conduits 20 and 22.

Elastic cord 60 is typically constructed of elastomer or rubber strands surrounded by a flexible sheath. Alternately, elastic cord 60 can be a single band of rubber, or a coiled tension spring, or any resilient material, either covered or not covered by a flexible sheath.

Elastic cord 60 is attached between conduits 20 and 22 under tension. Because elastic cord 60 is under tension, it holds extension 52 within socket 54. Sufficient tension must be provided to reliably hold conduits 20 and 22 together while the inventive snorkel is being used.

Figure 4:
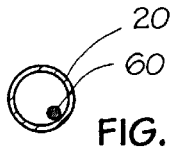
FIG. 4 is a sectional view of the inventive snorkel of FIG. 2 taken along a plane corresponding to line 4—4 of FIG. 2.

As best shown in FIG. 4, the cross-sectional diameter of elastic cord 60 is significantly less than the inside diameter of the conduit. Consequently, elastic cord 60 will not interfere with respiratory flow through conduits 20 and 22, and it also will not interfere with the purging of water from the conduits. Furthermore, in the preferred configuration, attachments 62 and 64 of elastic cord 60 are advantageously located so that elastic cord 60 is routed along and held tightly against the curving inside wall of the conduits.

Although the preferred configuration makes use of a single elastic cord, or-the-like, multiple elastic cords can be used to provide the same result.

Figure 5:
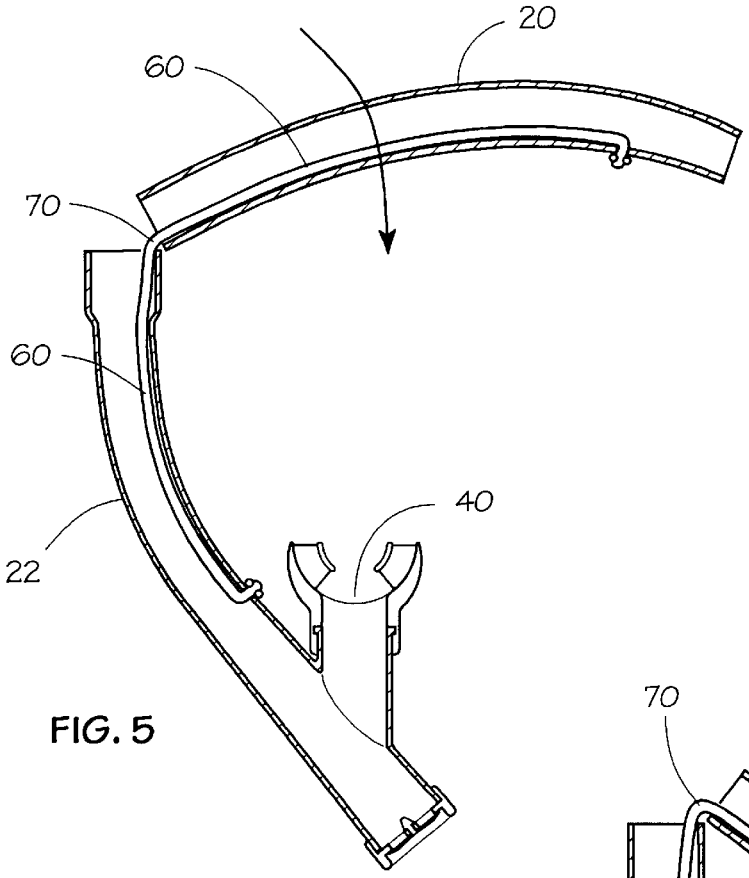
FIG. 5 is a sectional view of the inventive snorkel of FIG. 3 showing the snorkel segments partially folded.
Figure 6:
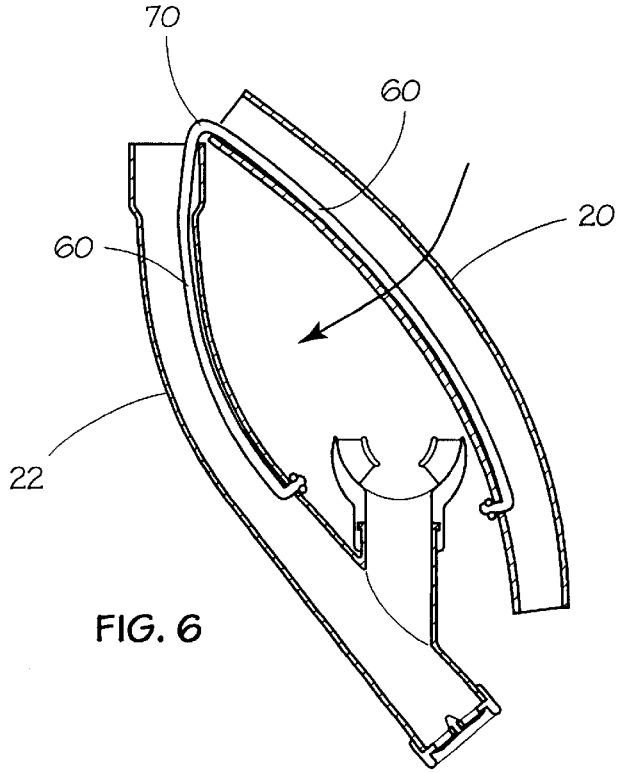
FIG. 6 is a sectional view of the inventive snorkel of FIG. 3 showing the snorkel segments folded closely together.

When conduits 20 and 22 are pulled apart as shown in FIG. 3, the tension of elastic cord 60 will increase. As shown in FIGS. 5 and 6, even when conduits 20 and 22 are pulled apart and rotated relative to one another, elastic cord 60 will continue to connect the two conduits.

Elastic cord 60 serves as a hinge, denoted by 70 in FIGS. 5 and 6, when conduits 20 and 22 are rotated relative to one another. FIG. 6 shows conduits 20 and 22 folded together in one of many possible arrangements. Many other folded orientations or positions are possible because connecting elastic cord 60 will serve as a hinge in any direction. The use of elastic cord 60 as a hinge eliminates the need for any other type of mechanical hinge or device at joint 50, thereby simplifying the assembly and lowering fabrication costs.

When conduits 20 and 22 are separated, the increased tension of elastic cord 60 continuously tries to pull extension 52 back into socket 54. Consequently, conduits 20 and 22 must be physically held in the folded position by placing the folded snorkel in a pocket or package, or by tying the conduits together with an external cord, or-the-like. When the folded conduits are released, the tension is elastic cord 60 will cause conduits 20 and 22 to immediately return to the unfolded and mated position. This is a safety feature because the inventive snorkel automatically reverts to the erect relationship needed for usage. Additionally, once conduits 20 and 22 are joined, the tension of elastic cord 60 will prevent conduits 20 and 22 from inadvertently separating when the diver or swimmer is breathing through the inventive snorkel.

Figure 7:
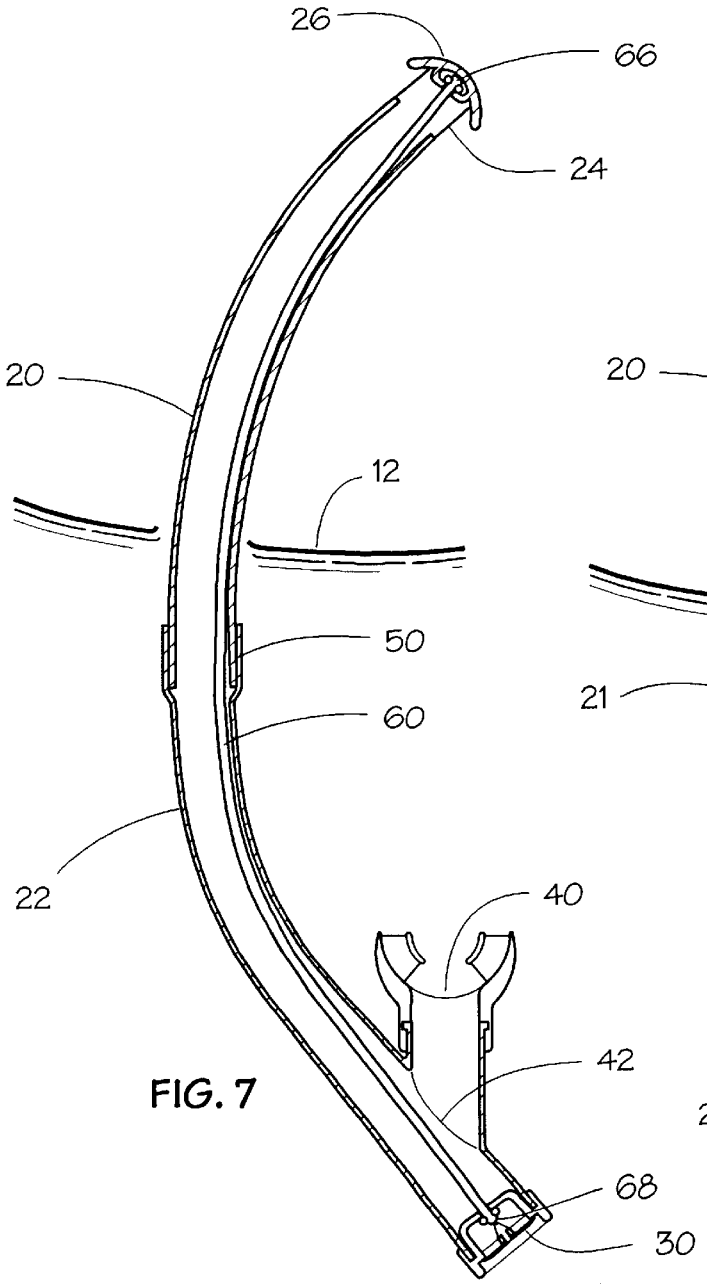
FIG. 7 is a sectional view of an alternate configuration of the inventive snorkel.

Referring to FIG. 7, an alternate configuration of the inventive snorkel incorporates cap 26 adjacent upper opening 24. Cap 26 serves to prevent water from splashing into conduit 20. Many such splash-preventing devices are known by the prior art; as another example, cap 66 can be constructed as a series of louvers for the purpose of hindering the flow of water into conduit 20 without interfering with respiratory flow.

FIG. 7 also shows two of the many ways that elastic cord 60 can be attached within inventive snorkel 10. One end of elastic cord 60 is attached to cap 26 at 66, and the other end of elastic cord 60 is attached to purge valve 30 at 68.

Figure 8:
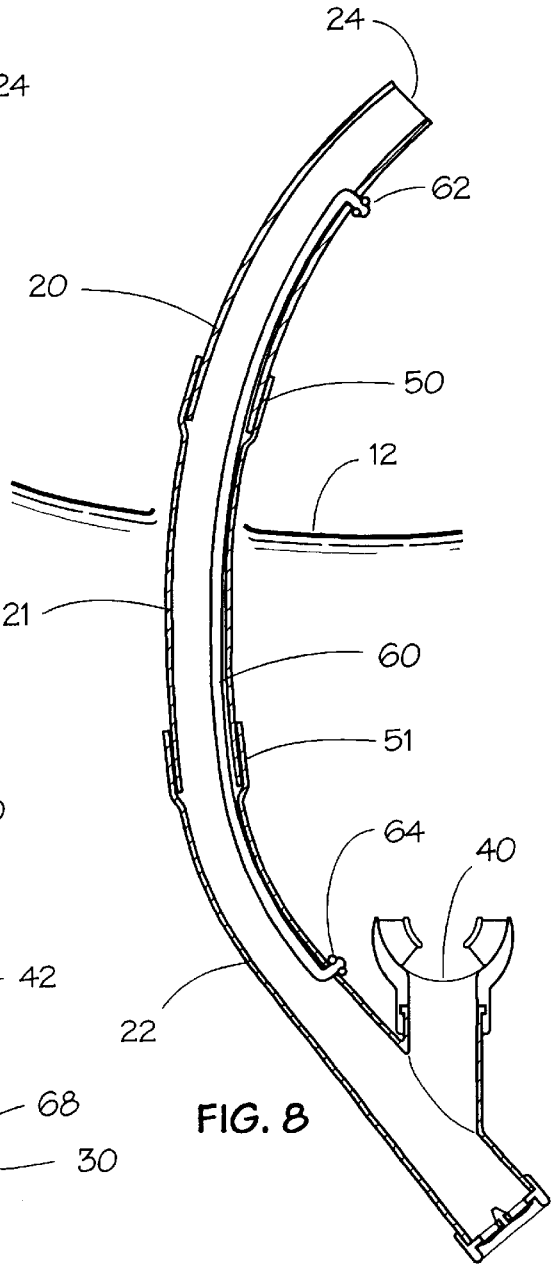
FIG. 8 is a sectional view of yet another alternate configuration of the inventive snorkel.

FIGS. 1–7 picture inventive snorkel 10 as being a conduit divided into two segments that can be folded together. However, the snorkel conduit can be divided into more than two segments, all having water tight joints between them and all connected by an elastic cord or-the-like. For example, FIG. 8 shows the inventive snorkel divided into three segments, conduits 20, 21 and 22. Referring again to FIG. 8, joint 50 joins upper conduit 20 to intermediate conduit 21; and joint 51 joins intermediate conduit 21 to lower conduit 22. A three segment snorkel has the advantage of being foldable to more compact dimensions.

Other variations are contemplated regarding the number and shape of the conduit segments, the type of joints and seals used to join the segments, and the size and number of elastic cords used to connect the segments. It is understood that those skilled in the art may conceive of modifications and/or changes to the invention described above. Any such modifications or changes that fall within the purview of the description are intended to be included therein as well. This description is intended to be illustrative and is not intended to be limiting. The scope of the invention is limited only by the scope of the claims appended hereto.

What is claimed is:

1. A snorkel device comprising:

a conduit having first and second ends thereof;

said conduit first end adapted to admit ambient fluid into said conduit;

mouthpiece joined to said conduit between said first and second ends for communicating fluid flow with said conduit;

said conduit divided into at least segments that have joints between said conduit first and second ends, said joints adapted to enable separation of said conduit segments; and forcing means adapted to pull said conduit segments together.

2. The snorkel device recited in claim 1 wherein:

said forcing means is contained within said conduit.

3. The snorkel device recited in claim 1 wherein:

said joints are substantially watertight.

4. The snorkel device recited in claim 1 wherein:

said conduit segments are aligned by said forcing means.

5. The snorkel device recited in claim 1 wherein:

said forcing means provides a tension force.

6. The snorkel device recited in claim 1 wherein:

said forcing means connects said conduit segments when said conduit segments are separated.

7. The snorkel device recited in claim 1 wherein: said forcing means is an elastomer.

8. The snorkel device recited in claim 1 wherein:

said forcing means is a tension spring.

9. The snorkel device recited in claim 1 having:

purging means joined to said conduit second end for selectively providing unidirectional flow from said conduit to ambient.

10. A snorkel device comprising:

a conduit having first and second ends thereof;

said conduit first end adapted to admit ambient fluid into said conduit;

mouthpiece joined to said conduit adjacent said conduit second end for communicating fluid flow with said conduit;

said conduit is divided into at least two segments that are joined by substantially watertight joints, said joints are not hinged thereby enabling said conduit segments to be completely separated when said conduit segments are pulled apart; and forcing means contained within said conduit; said forcing means adapted to hold said conduit segments joined together; and said forcing means functions to connect and maintain the sequential relationship of said conduit segments when they are separated.

11. The snorkel device recited in claim 10 wherein:

said forcing means has first and second ends thereof; said forcing means first end is attached to said conduit adjacent said conduit first end; and said forcing means second end is attached to said conduit adjacent said conduit second end.

12. The snorkel device recited in claim 10 wherein:

said forcing means has first and second ends thereof; said forcing means first end is attached to the conduit segment that has said conduit first opening; and said forcing means second end is attached to the conduit segment that has said conduit second opening.

13. A snorkel device comprising:

a first conduit having first and second ends thereof;

said first conduit first end adapted to admit ambient fluid into said conduit;

a second conduit having first and second ends thereof;

mouthpiece joined to said second conduit second end for communicating fluid flow with said conduit;

said first conduit second end and said second conduit first end adapted to form an unhinged joint that is substantially watertight; and forcing means contained within at least a portion of said first and second conduits; said forcing means adapted to hold said joint together; and said forcing means functions as an omni-directional hinge between said first and second conduits when said first and second conduits are separated.

14. The snorkel device recited in claim 13 wherein:

said first conduit second end is a socket adapted to receive said second conduit first end.

15. The snorkel device recited in claim 13 wherein:

said second conduit first end is a socket adapted to receive said first conduit second end.

* * * * *